United States Patent [19]

Tafoya

[11] 4,046,199

[45] Sept. 6, 1977

[54] STEAM INJECTION APPARATUS AND METHOD

[75] Inventor: Vincent G. Tafoya, Bakersfield, Calif.

[73] Assignee: Union Oil Company of California, Brea, Calif.

[21] Appl. No.: 703,053

[22] Filed: July 6, 1976

[51] Int. Cl.[2] ..... E21B 43/24; E21B 43/25

[52] U.S. Cl. ..... 166/303; 166/222

[58] Field of Search ..... 166/222, 223, 272, 303, 166/169, 112, 100; 175/11, 17, 422

[56] References Cited

U.S. PATENT DOCUMENTS

| | | | |
|---|---|---|---|
| 1,279,333 | 9/1918 | Green | 166/222 |
| 1,400,765 | 12/1921 | Pallette | 166/222 X |
| 2,117,648 | 5/1938 | Bottorf | 166/222 UX |
| 2,329,157 | 9/1943 | Frack | 166/222 |
| 2,785,875 | 3/1957 | Hayes | 166/223 X |
| 2,871,948 | 2/1959 | Normand | 166/303 X |
| 2,906,337 | 9/1959 | Hennig | 166/272 X |
| 3,349,849 | 10/1967 | Closmann | 166/303 X |
| 3,525,399 | 8/1970 | Bayless et al. | 166/303 |
| 3,858,654 | 1/1975 | Walker | 166/303 X |

*Primary Examiner*—Stephen J. Novosad
*Attorney, Agent, or Firm*—Richard C. Hartman; Dean Sandford; Gerald L. Floyd

[57] ABSTRACT

An apparatus and method for directing steam into selected strata of a relatively thick subterranean formation penetrated by a well. The apparatus includes an elongated housing attachable to the lower end of the well tubing, the housing having a closed lower end and a plurality of jets spaced around the sidewall thereof so as to be positioned opposite the strata to be treated. The jets direct the steam outwardly and downwardly against the formation face, causing it to preferentially enter the selected strata.

15 Claims, 3 Drawing Figures

STEAM INJECTION APPARATUS AND METHOD

BACKGROUND OF THE INVENTION

1. Field of the Invention

This invention relates to an apparatus and method for directing stream into a subterranean formation penetrated by a well. More particularly, the invention relates to an apparatus and method to receive steam injected down the well via a conduit and direct the steam against and into a selected section of a subterranean formation.

2. Description of the Prior Art

Steam injection is a well known method for stimulating the recovery of hydrocarbons from subterranean formations penentrated by a well. The method is especially applicable to recovery of highly viscous hydrocarbons having a high resistance to flow under normal subterranean conditions of temperature and pressure, but whose viscosity can be reduced and flow rate increased by the application of heat thereto. In the steam injection process as commonly practiced, steam is generated at the surface of the ground and injected down the well via an open-bottom-ended conduit. The steam exits the bottom of the conduit and enters the formation at the most permeable point along the well sidewall, wherever this most permeable point may be located. Thus, there is limited selectivity in the injection process. A packer cannot be used below the conduit to confine the steam to a limited area because during the steaming operation some formation particles slough into the hole and build up on top of the packer. Thus, the packer easily becomes stuck in the hole and cannot be readily removed following the steaming operation.

In the formation treating operations, it is often desired to inject steam into a particular stratum of the formation, which may or may not be the most permeable portion thereof. Additionally, it may be desired to inject steam first into one particular stratum of a formation for some time and then into another stratum of the formation. This is true where the formation is made up of alternate horizontal layers of an oil-containing strata and a shale strata. In using the open-bottom-ended conduit of the prior art, it was difficult to inject steam into anything other than the most permeable strata. Even when the position of the conduit is changed to be adjacent a second strata into which it was desired to inject steam, the steam still tended to go primarily into the most permeable strata which was previously treated.

Accordingly, a principal object of this invention is to provide an apparatus and method for injecting steam into selected strata of a subterranean formation.

Another object of the invention is to provide such an apparatus and method for successively steaming a plurality of oil-containing strata separated by shale strata.

Still another object of the invention is to provide such an apparatus and method which inject steam into such a formation with a minimum of erosion of the formation.

A further object of the invention is to provide such an apparatus which attaches to the bottom of the tubing and whose vertical position in the well can be changed between steam cycles by raising or lowering the tubing.

A still further object of the invention is to provide such an apparatus and method capable of injecting steam into a desired stratum of the formation without the aid of packers.

Other objects, advantages and features of the invention will be apparent from the following description.

SUMMARY OF THE INVENTION

Briefly, the invention involves an apparatus and method for improving the production of oil from relatively thick subterranean formations containing viscous hydrocarbons and penetrated by a well by the injection of steam into selected strata of the formation. The steam injecting apparatus is made up of an elongated hollow housing sized to be passed through a well, a coupling attaching the upper end of the housing to the lower end of the well tubing, a plug in the lower end of the housing, a plurality of apertures spaced apart circumferentially at regular intervals around and extending through the sidewall of the housing, jet nozzles extending outwardly and downwardly from each aperture, and, optionally, means to reduce the amount of steam which would otherwise rise into the tubing-casing annulus. The apparatus is attached to the bottom end of the well tubing and run into the well opposite the base of the strata which is to be treated with steam. Steam is generated at the surface, passes down the well tubing, into the elongated hollow housing, out through the jet nozzles, following which it impinges against and enters the formation at this point.

BRIEF DESCRIPTION OF THE DRAWINGS

The invention will be more readily understood by reference to the accompanying drawings, in which.

DESCRIPTION OF THE PREFERRED EMBODIMENTS

Figure 1:
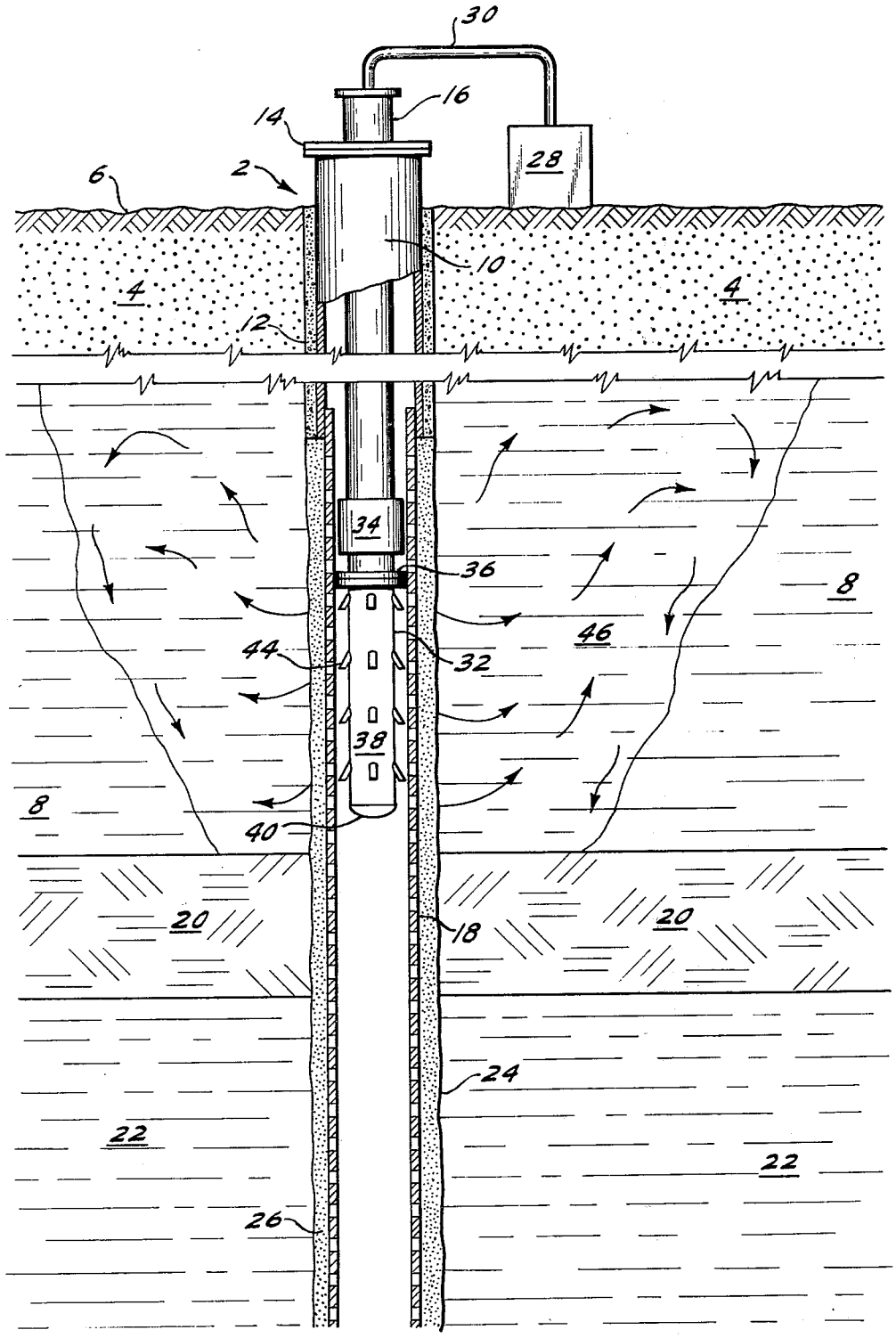
FIG. 1 is a vertical view, partially in cross-section, through a subterranean earth formation schematically illustrating a well equipped with the apparatus of this invention which is positioned opposite a formation into which steam is being injected.

Referring now to FIG. 1, well 2 is drilled through overburden 4 lying beneath surface 6 and extends through first oil-bearing formation 8. Well 2 contains casing 10 which is cemented in place through overburden 4 and part way into first oil-bearing formation 8 with cement sheath 12. Casing 10 is provided with conventional well head assembly 14 which forms a closure at the surface end of casing 10. Casing 10 contains tubing conduit 16 the upper end of which extends through well head assembly 14 and the lower end of which terminates in the open hole below casing 10 and opposite first oil-bearing formation 8. The open hose below casing 10 contains perforated liner 18 which extends over first oil-bearing formation 8, underlying shale strata 20 and second oil-bearing formation 22. The annular space between perforated liner 18 and sidewall 24 of well 2 is filled with gravel 26. Steam is generated by conventional steam generating apparatus 28 positioned at surface 6 near well 2 and is injected into tubing 16 via flow line 30. Steam passes down tubing 16 and into steam injecting apparatus 32 which is attached to the lower end of tubing 16 by coupling 34. Double swab cups 36 attached to the upper portion of steam injecting apparatus 32 prevent steam from rising into the annular space surrounding tubing 17 above steam injecting apparatus 32.

Figure 2:
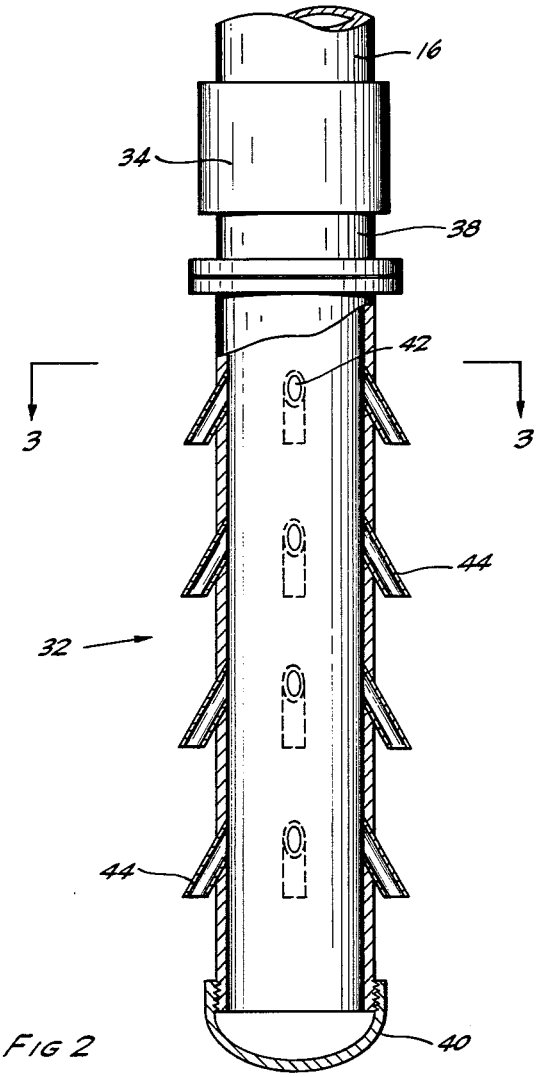
FIG. 2 is an elevation view, partially in cross-section, showing in detail the steam injection apparatus.
Figure 3:
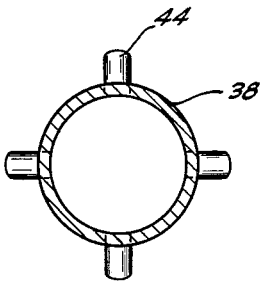
FIG. 3 is a horizontal cross-sectional view of the apparatus illustrated in FIG. 2 taken along the line 3—3 of FIG. 2.

Referring now particularly to FIG. 2 and FIG. 3 as well as FIG. 1, steam injection apparatus 32 includes housing, chamber, pipe section or nipple 38 which is generally of about the same diameter as tubing 16 to which is is attached by coupling 34. The lower end of housing 38 is closed as by bull plug 40 or any convenient plugging means to close off the otherwise open lower end of housing 38. The sidewall of housing 38 contains a plurality of spaced apart ports or apertures 42 through which jet nozzles or tubes 44 extend outwardly from housing 38 and downwardly towards the sidewall of well 2. Steam passing into steam injection apparatus 32 from tubing 16 is forced out through jets 44 and directed against and into first oil-bearing formation 8. Thus, there is formed in formation 8 a relatively uniform cylindrical steam-containing area 46. Area 46 surrounds well 2 and is opposite steam injecting apparatus 32. The hydrocarbons contained in area 48 are heated by the steam, substantially reduced in viscosity, and rendered more susceptible to removal from area 46 in oil recovery operations carried out in conjunction wih or subsequent to the steam injection process.

Elongated hollow housing 38 of steam injecting apparatus 32 is removably attached to the lower end of tubing 16 and receives the steam injected down tubing 16. Housing 38 can be of any convenient shape as long as it can be lowered through casing 10. It is generally cylindrical in shape for convenience in attaching to tubing 16. A 6-foot-long housing can be conveniently used in many steaming operations. Housing 38 is attached to tubing 16 by threaded coupling 34 or any similar attaching means. Plug or stopper 40 closes the bottom end of housing 38 so that steam cannot escape out the bottom end. Plug 40 can conveniently be a threaded bull plug or similar closure means threaded onto or into the bottom end of housing 38. Ports or outlets 42 in the sidewall of housing 38 are apertures drilled or machined in the said sidewall through which steam entering housing 38 escapes. Apertures 42 are spaced around the sidewall of housing 38, preferably at regular intervals so that steam is uniformly injected from housing 38 and against surrounding formation 8. One convenient arrangement of apertures 42 is in horizontal rows, each aperture 42 being spaced 90° from the nearest other apertures 42 and with the rows being about one foot apart. Each aperture 42 is provided with a jet nozzle or tube 44. Jet nozzles 44 are affixed in or around apertures 42 as by welding or being screwed in. Jet nozzles 44 are either hollow tubes originally or are solid rods through which a hole is drilled after being affixed in or around apertures 42. A preferred structure is provided by first welding hollow tube jet nozzles 44 onto housing 38 and then milling a hole through housing 38 as by inserting a milling tool up through hollow tube jet nozzles 44. This provides a smooth opening through which steam can flow. If jet nozzles 44 are screwed into apertures 42, car should be exercised that jet nozzles 44 do not extend inside housing 38 as such an arrangement tends to slow down the flow of steam out of housing 38. The openings through jet nozzles 44 are sized so that steam from housing 38 escapes therethrough at a force sufficient to impinge against and penetrate formation 8. It is found that if steam is passed laterally through apertures 34 straight out against formation 8 with or without jet nozzles 44 being present, the steam impinges upon formation 8 with a force sufficient to severely erode formation 8. Better penetration of steam with a minimum of erosion is achieved by positioning jet nozzles 44 so that the steam inpinges against formation at an angle of from 20° to 40° from the axis of the well, preferably about 30°. By pointing jet nozzles 44 downwardly, the natural tendency of steam to rise in the annulus between well 2 and steam-injecting apparatus 22 is at least partially offset.

Apertures 42 and jet nozzles 44 should be of sufficient number and arrayed around steam injection apparatus 32 in such a manner that steam passing therethrough contacts the entire vertical extend of formation 8 opposite steam-injecting apparatus 32 in a substantially uniform manner. This forces steam into formation 8 for a substantial depth regardless of any permeability variations that might exist over this vertical extent. Jet nozzles 44 are sufficiently long to direct the steam at the proper angle, but not so long as to provide an obstruction to the passage of steam-injecting apparatus 32 into and out of well 2.

After completion of a first steaming operation in first oil-bearing formation 8, steam injecting apparatus 32 can be lowered to a position near the base of second oil-bearing formation 22 and a second steaming operation carried out. In this second steaming operation, the unique steam injection apparatus 32 will force steam primarily into second oil-bearing formation 22 rather than into first oil-bearing formation 8 even though the latter formation is the more permeable zone.

It is helpful in some instances to begin a steam injection process by injecting into flow line 30 for a short period of time, said 12 hours, low quality steam, e.g., steam containing about 50 percent by weight to about 70 percent by weight steam and the remainder water. The steam quality is measured as it exits steam generator 28. This low quality steam contains a substantial amount of hot water and serves to flush and clean out flow line 30 which may contain formation particles deposited during previous operations of well 2. If high quality steam is injected into flow line 30 which is dirty, the steam tends to entrain the formation particles, carry them downhole and impinge them against liner 18 at such a high velocity that liner 18 may be damaged. If flow line 30 is first cleaned with low quality steam, less damage to liner 18 occurs.

For the remainder of the steaming operation it is preferred to employ high quality steam, i.e., that containing more than about 70 percent by weight and most preferably at least about 80 percent by weight steam.

The steam injecting apparatus of this invention is further demonstrated by the following example which is presented by way of illustration, and is not intended as limiting the spirit and scope of the invention as defined by the appended claims.

EXAMPLE

A well has a producing zone extending from 1,290 feet to 1,480 feet. The well is given two conventional steam treatments with oil production between treatments. The well is then given a third conventional steam treatment wherein 4,100 MM B.T.Us. of steam are injected out of the open-bottom-ended tubing positioned at 1,250 feet for a period of 10 days. A radioactive tracer is added to the last portion of the steam. A log of the formation following the steam treatment indicates that the steam enters the formation from 1,280 feet to 1,390 feet. Thus, the lower portion of the producing zone receives no steam. The well is produced for 8 months. The well is then given a steam treatment using the apparatus of this invention. A 6-foot long, 2-inch diameter steaming nipple having four 0.5 inch inside diameter 0.75 inch long jets per foot is attached to the bottom end of the tubing and suspended in the well at a depth of 1,420 feet. The jets are circumferentially arranged around the nipple in a uniformly spaced manner and point downwardly at an angle of 30° from the vertical. The lower end of the nipple is closed with a bull plug. Steam injected down the tubing, through the steaming nipple and into the formation totals 3,500 MM B.T. Us. during a period of 10 days. A radioactive tracer is added to the last portion of the steam. A log of the formation following the steam treatment indicates that the steam enters the formation from 1,375 feet to 1,455 feet. The well is produced for 8 months during which time 2,000 barrels more oil is recovered than during the 8 months following the last conventional steaming operation. Thus, the use of the steaming nipple results in steam entering the lower portion of the formation and more oil being recovered even though less steam was used than in the previous conventional steam treatment.

While in particular embodiments of the invention have been described, it will be understood, of course, that the invention is not limited thereto since many modifications can be made and it is intended to include within the invention such modifications as are within the scope of the claims.

The invention having thus been described, I claim:

1. An apparatus for injecting steam into a subterranean formation via a tubing-containing well penetrating the subterranean formation comprising:

an elongated hollow housing having sidewalls, an open upper end an an open lower end, said open upper end being adapted to be attached to the lower end of the tubing;

coupling means for attaching the upper end of the elongated hollow housing to the bottom end of the tubing;

plug means to close the open lower end of the elongated hollow housing;

a plurality of circumferentially-spaced apertures in the sidewall of the elongated hollow housing;

a jet nozzle extending outwardly and downwardly from each aperture at an angle of from 20° to 40° from the axis of the well;

a steam source means located at the earth surface for generating steam; and a steam conduit means connecting the said steam source means and the said upper end of the elongated hollow housing for conducting steam to the said housing;

whereby steam injected down the tubing enters the elongated hollow housing, passes through the jet nozzles and is injected into the subterranean formation.

2. The apparatus defined in claim 1 wherein said elongated hollow housing is a pipe section.

3. The apparatus defined in claim 1 wherein said coupling means is a threaded pipe coupling.

4. The apparatus defined in claim 1 wherein said plug means is a threaded bull plug, and wherein the lower end of said housing is threaded to receive said bull plug.

5. The apparatus defined in claim 1 wherein said apertures are uniformly spaced around the sidewall of the elongated hollow housing so that steam passing through said jet nozzles impinges substantially uniformly over the vertical section of the subterranean formation contacted by the steam.

6. The apparatus defined in claim 1 wherein said jet nozzles extend downwardly toward the subterranean formation at an angle of about 30° from the axis of the well.

7. The apparatus defined in claim 1 wherein said apparatus also includes a swab cup attached to the upper portion of said elongated hollow housing.

8. An apparatus for injecting steam into a vertical section of a subterranean formation via a tubing-containing well penetrating the subterranean formation comprising:

a. a pipe section of about the same length as the vertical section to be treated;

b. coupling means for attaching the upper end of the pipe section to the bottom end of the tubing;

c. plug means to seal the lower end of the pipe section;

d. a plurality of circumferentially-spaced apertures in the pipe section;

e. a jet nozzle extending outwardly and downwardly from each aperture at an angle of from 20° to 40° from the vertical, the apertures and jet nozzles being arrayed around the pipe section in number and position so that steam passing therethrough contacts the formation in a substantially uniform manner;

f. a steam source means located at the earth surface for generating steam; and g. a steam conduit means connecting the said steam source means and the said upper end of the elongated hollow housing for conducting steam to the said housing.

9. The apparatus defined in claim 8 wherein said coupling means is a threaded pipe coupling.

10. The apparatus defined in claim 8 wherein the plug means of step (c) is a bull plug.

11. The apparatus defined in claim 8 wherein the jet nozzles extend downwardly toward the subterranean formation at an angle of about 30° from the vertical.

12. A method of injecting steam into a first selected strata of a subterranean formation penetrated by a conduit-containing well comprising:

positioning the conduit so that the lower end thereof is just above the base of the first selected strata, and passing steam down the conduit, into an elongated closed-bottom-ended elongated housing attached to the bottom of the conduit, out apertures in the sidewall of said housing, through jet nozzles extending beyond each aperture, said jet nozzles pointing outwardly and downwardly from said housing at an angle of from 20° to 40° with respect to the axis of the well and against and into the first selected strata opposite the jet nozzles.

13. The method defined in claim 12 wherein said housing has a swab cup attached to the upper portion thereof to aid in confining the injected steam to the first selected strata.

14. The method defined in claim 12 wherein following injection of steam into said first selected strata, the conduit is lowered so that the lower end thereof is just above the base of a second selected strata and steam is injected into said second selected strata in the same manner as it was previously injected into said first selected strata.

15. The method defined in claim 14 wherein said housing has a swab cup attached to the upper portion thereof to aid in confining the injected steam to the second selected strata.

* * * * *